US008753251B2

(12) United States Patent
Boutenko et al.

(10) Patent No.: US 8,753,251 B2
(45) Date of Patent: Jun. 17, 2014

(54) JAW EXERCISER

(75) Inventors: Victoria Boutenko, Ashland, OR (US); Olga Proseanik, Clearwater, FL (US); Sergei Boutenko, Ashland, OR (US); Valya Boutenko, Ashland, OR (US); Anna Proseanik, Webster, NY (US)

(73) Assignees: Victoria Boutenko; Vladimir Proseanic

( * ) Notice: Subject to any disclaimer, the term of this patent is extended or adjusted under 35 U.S.C. 154(b) by 9 days.

(21) Appl. No.: 13/438,683

(22) Filed: Apr. 3, 2012

(65) Prior Publication Data

US 2012/0190506 A1 Jul. 26, 2012

Related U.S. Application Data

(63) Continuation of application No. 12/653,638, filed on Dec. 16, 2009, now Pat. No. 8,172,725.

(60) Provisional application No. 61/201,984, filed on Dec. 17, 2008.

(51) Int. Cl.
*A63B 21/00* (2006.01)

(52) U.S. Cl.
USPC ..... 482/11; 15/143.1

(58) Field of Classification Search
USPC ..... 482/11, 121, 82, 10; 15/143.1, 22.1; D24/180, 143.1
See application file for complete search history.

(56) References Cited

U.S. PATENT DOCUMENTS

| | | | | |
|---|---|---|---|---|
| 1,586,499 | A | 5/1926 | Worth | |
| 2,249,721 | A | 7/1941 | Morris | |
| 3,295,519 | A | 1/1967 | Gerber | |
| 4,185,817 | A | 1/1980 | Peterson | |
| 5,115,530 | A * | 5/1992 | Distiso | 15/25 |
| 5,386,821 | A * | 2/1995 | Poterack | 128/200.26 |
| 5,577,983 | A | 11/1996 | Fraser | |
| 5,582,560 | A | 12/1996 | Magnuson | |
| D397,442 | S * | 8/1998 | Kittelsen | D24/180 |
| 6,371,758 | B1 | 4/2002 | Kittelsen | |
| 6,524,225 | B1 | 2/2003 | Arias | |
| 6,918,153 | B2 * | 7/2005 | Gruber | 15/22.1 |

* cited by examiner

*Primary Examiner* — Jerome W Donnelly

(57) ABSTRACT

A jaw exerciser is provided. The jaw exerciser includes an elongated first portion having a first cross-sectional area, wherein the elongated first portion is configured to be inserted into the mouth, and includes an outer surface adapted to be engaged and clenched by the teeth. The jaw exerciser also includes an elongated second portion having a second cross-sectional area and an outer surface, wherein the elongated second portion is configured to remain outside the mouth when the first portion is inserted into the mouth. Furthermore, the jaw exerciser includes an intermediate portion having a third cross-sectional area. The intermediate portion joins the elongated first and second portions, and is configured to be grasped and encircled by the lips to thereby retain saliva inside the mouth.

9 Claims, 8 Drawing Sheets

JAW EXERCISER

CROSS REFERENCE TO RELATED APPLICATIONS

This application is a Continuation application of U.S. patent application Ser. No. 12/653,638 filed Dec. 16, 2009 now U.S. Pat. No. 8,172,725 which claims the benefit of U.S. Provisional Application Ser. No. 61/201,984 filed Dec. 17, 2008, the entire contents of which are hereby incorporated by reference.

TECHNICAL FIELD

The invention relates to devices for strengthening musculature of the face, and, in particular, to a jaw exerciser.

BACKGROUND OF THE INVENTION

Exercise is often recommended as a means of improving motor skills, fitness, muscle and bone strength, and joint function. Typically, exercise has beneficial effects upon musculature, connective tissue, bone, and nerves that stimulate the muscles.

A human lace has a multitude of muscles, among which are four primary mastication, or chewing muscles. The mastication muscles include the masseter, or the jaw muscle, the temporalis, the medial pterygoid, and the lateral pterygoid. Each of these four mastication muscles is paired, with each side of the jawbone possessing one of the four.

In ordinary parlance, muscular "strength" usually refers to the ability to exert a force on an external object, for example, in order to lift a weight. By this definition, the masseter is the strongest of all human muscles. What distinguishes the masseter is the inherent mechanical advantage of working against a much shorter lever arm than other muscles in the human body. Similarly to other muscles within the human body, the masseter, along with the other three primary mastication muscles, may be exercised to enhance joint function, as well as to improve muscle and bone strength.

SUMMARY OF THE INVENTION

A jaw exerciser is provided. The jaw exerciser according to a first embodiment includes an elongated first portion having a first cross-sectional area. The elongated first portion is configured to be inserted into the mouth, and includes an outer surface adapted to be engaged and clenched by the teeth. The jaw exerciser also includes an elongated second portion having a second cross-sectional area and an outer surface. The elongated second portion is configured to remain generally outside the mouth when the first portion is inserted into the mouth. Furthermore, the jaw exerciser includes an intermediate portion having a third cross-sectional area. The intermediate portion joins the elongated first portion to the elongated second portion, and is configured to be grasped and encircled by the lips to thereby retain saliva inside the mouth.

The third cross-sectional area of the intermediate portion of jaw exerciser may be smaller than each of the cross-sectional areas of the first and second elongated portions. The first portion of the apparatus can be arranged at an angle relative to the second portion. Such an angle may have a magnitude equal to approximately 90 degrees. The third cross-sectional area may have either a substantially round or a substantially elliptical shape, and the outer surfaces of the first and second portions may be resilient.

The second portion of the exerciser may be configured with an outer surface that is adapted to be engaged and clenched by the teeth, such that the second portion may also be inserted into the mouth. The outer surface of the first portion, as well as the outer surface of the second portion, may include at least one projection. The outer surfaces of the first and second portions may be configured from a first material, and at least one of the first and second portions may include a cavity filled with a second material. Additionally, the jaw exerciser may have either one or both of its first and second portions saturated by either a medicinal or a fragrant substance.

A second embodiment of the jaw exerciser is also provided. The jaw exerciser according to the second embodiment includes two spaced-apart elongated first portions configured to be inserted into the mouth, and two elongated second portions linked together and configured to remain outside the mouth when the two first portions are inserted into the mouth. Each first portion is connected to a respective second portion via an intermediate portion configured to be grasped and encircled by the lips to thereby retain saliva inside the mouth. The two second portions of the exerciser can be linked together by a connecting portion.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
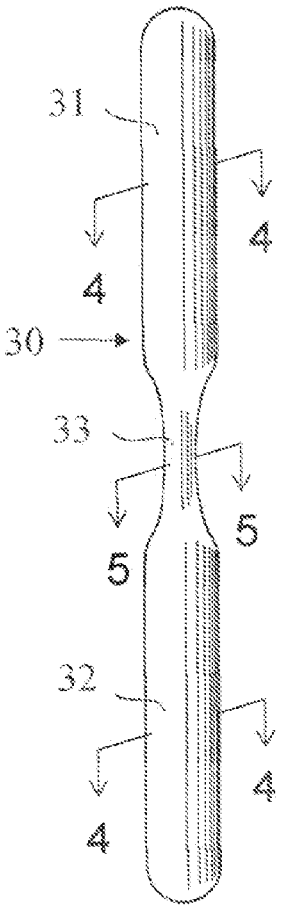
FIG. 1 is a plan view of an elongated jaw exerciser having a first, second, and intermediate third portions, where the cross-sectional area of the intermediate portion is smaller than the cross-sectional area of each of the first and second portions.

Referring to the drawings, wherein like reference numbers refer to like components, FIG. 1 shows a jaw exerciser 30. Jaw exerciser 30 includes an elongated first portion 31. Jaw exerciser 30 also includes an elongated second portion 32 that is joined to elongated portion 31 by an intermediate third portion 33. Elongated portion 31 is configured to be inserted into the mouth, while elongated second portion 32 remains outside the mouth. Elongated first portion 31 includes an outer surface adapted to be engaged and clenched by the teeth; however, either the first portion 31 or the second portion 32 may be selectively inserted into the mouth for exercise, thereby leaving the other portion outside the mouth. For this purpose, elongated second portion 32 may also include an outer surface adapted to be engaged and clenched by the teeth.

First portion 31 and second portion 32 are each characterized by a cross-sectional area 4-4, while intermediate third portion 33 is characterized by a cross-sectional area 5-5. Intermediate portion 33 is configured to be grasped and encircled by the lips to thereby retain saliva inside the mouth. To facilitate such a result, cross-sectional area 5-5 of intermediate third portion 33 is smaller then cross-sectional areas 4-4 of the first portion 31 and the second portion 32, as shown in FIG. 1. The second portion 32 disposed outside the mouth may be shifted and/or turned to adjust the position of the jaw exerciser's first portion 31 inside the mouth, thereby providing a comfortable and/or desired engagement with a pair of opposing chewing teeth. Additionally, such an arrangement provides inherent protection to the user from unintentional swallowing of the jaw exerciser 30. Jaw exerciser 30 inserted in the mouth is configured to allow for uninhibited breathing and speaking.

Materials used for jaw exerciser 30 may be resilient, as well as orally acceptable rubber, resin, silicone, or food-grade plastics. The combined length of first portion 31 and the second portion 32 is configured to exceed the typical distance between throat and teeth of a person. Such combined length of first portion 31 and the second portion 32 limits the likelihood of jaw exerciser 30 being swallowed by a person.

Figure 2:
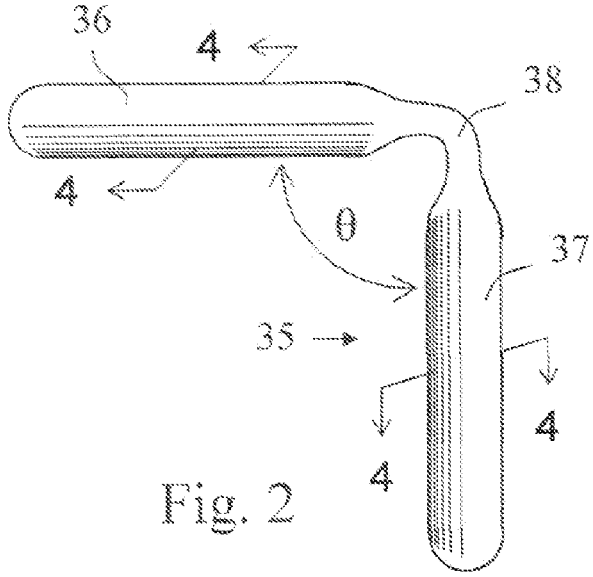
FIG. 2 is a plan view of a jaw exerciser having a first portion disposed at an angle relative to the second portion.
Figure 3:
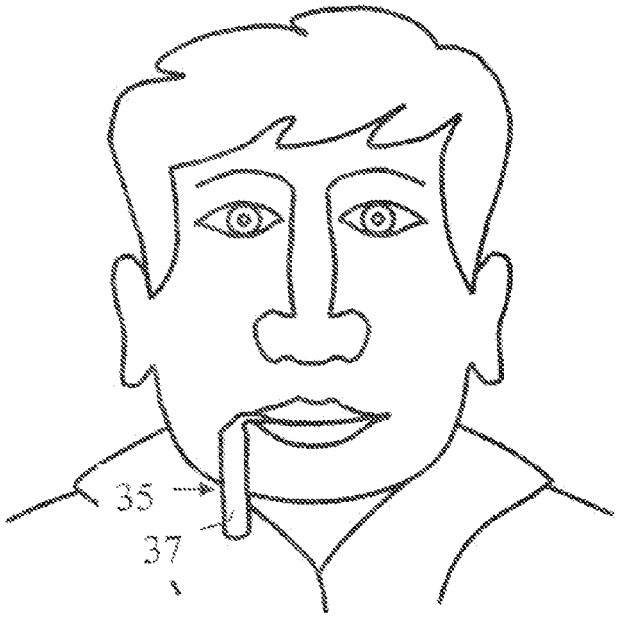
FIG. 3 illustrates an application of the jaw exerciser shown in FIG. 2.

FIG. 2 shows jaw exerciser 35 having elongated first and second portions 37 and 36. Elongated first and second portions 36 and 37 are identical to portions 31 and 32, respectively, shown in FIG. 1, except that portion 36 is disposed at an angle θ to portion 37 to prevent unintentional swallowing of the exerciser by the user, and to allow for uninhibited breathing during exercise. Angle θ is shown in FIG. 2 as being equivalent to approximately 90 degrees, but any other angle may also be selected. FIG. 3 shows jaw exerciser 55 disposed within a mouth of a person, with portion 37 positioned outside the person's mouth.

Figure 4A:
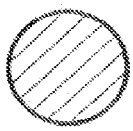
FIGS. 4(*a-o*) illustrate alternative shapes of cross-sectional areas of the outer surfaces of the first and second portions of jaw exerciser shown in FIGS. 1 and 2.
Figure 4B:
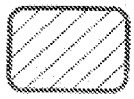
Figure 4C:
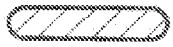
Figure 4D:
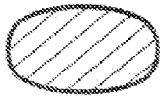
Figure 4E:
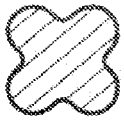
Figure 4F:
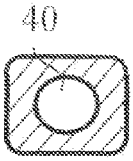
Figure 4G:
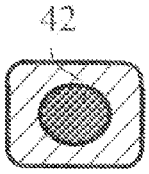
Figure 4H:
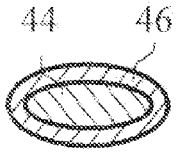
Figure 4I:
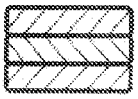
Figure 4J:
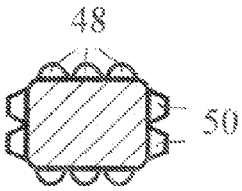
Figure 4K:
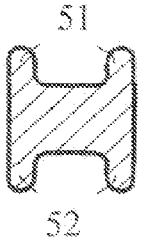
Figure 4L:
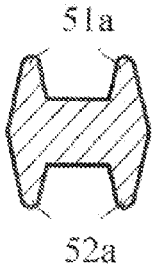
Figure 4M:
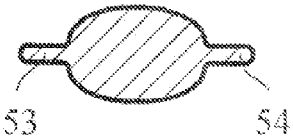
Figure 4N:
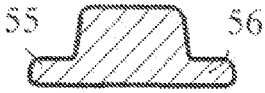
Figure 4O:
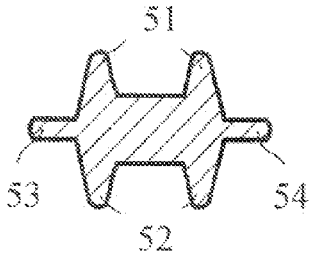

Cross-sectional area 4-4 of the first and second portions 36, 37 (as well as of first and second portions 31 and 32 of FIG. 1) may have various shape and structure, as shown in FIGS. 4*a*-4*o*. Cross-sectional area 4-4 may have a round shape (FIG. 4*a*), a square shape (FIG. 4*b*), flat (FIG. 4*c*), an oval shape (FIG. 4*d*), or a "clover leaf" shape (FIG. 4*e*), thereby providing a desired engagement of jaw exerciser 35 (or jaw exerciser 30 of FIG. 1) with chewing teeth of a particular size and configuration. First and/or second portions 36, 37 (as well as first and/or second portions 31, 32 of FIG. 1) may have an internal cavity 40, as seen relative to the cross-sectional area 4-4 in FIG. 4*f*, and a filler 42, as seen in FIG. 4*g*. First and/or second portions 31, 32 and 36, 37 may also be configured such that the outer surfaces of either one or both of the first and second portions are formed from a first material 46 and include a cavity filled with a second material 44 (shown in FIG. 4*h*).

First portions 31, 32 and/or second portions 36, 37 may have a multilayer structure (FIG. 4*i*) allowing to influence rigidity of jaw exerciser 30, 35. Cross-sectional area 4-4 may also have protrusions in the form of rounded bumps 48 and squared humps 50, as shown in FIG. 4*j*, opposing ribs 51 and 52 (FIG. 4*k*), diamond-shaped ribs 51*a* and 52*a* (FIG. 41), intermediate horizontal skirts 53 and 54 (FIG. 4*m*), perimeter skirts 55 and 56 (FIG. 4*n*), or a combination of ribs 51, 52 and skirts 53, 54 (FIG. 4*o*). These configurations of cross-sectional area 4-4 provide reliable, individually desirable positioning of opposing chewing teeth on the outer surface of jaw exercisers 30 and 35, and assist in preventing teeth from slipping and inflicting injury to the person's mouth.

Cross-sectional area 5-5 of jaw exerciser's intermediate portion may also have various shapes, as shown in the FIGS.

Figure 5A:
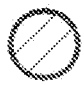
FIGS. 5(*a-c*) illustrate alternative shapes of cross-sectional areas of the intermediate portion of jaw exerciser shown FIGS. 1 and 2.
Figure 5B:
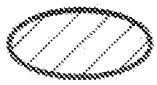
Figure 5C:
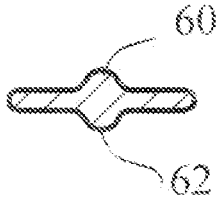

5*a*-5*c*. Cross-sectional area 5-5 may have a round shape (FIG. 5*a*), an oval shape (FIG. 5*b*), a flat shape with low-profile ribs 60 and 62 on each side of the flat (FIG. 5*c*), or any other shape capable of being encircled by the lips such that saliva is retained inside the mouth.

Figure 6:
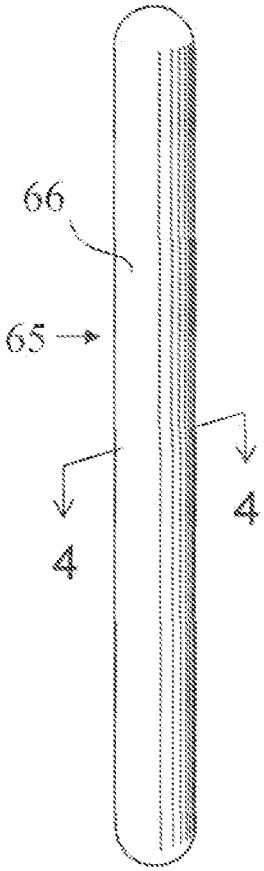
FIG. 6 is a plan view of an elongated jaw exerciser having a first, second, and intermediate third portions, wherein all three portions have equivalent cross-sectional areas.
Figure 7:
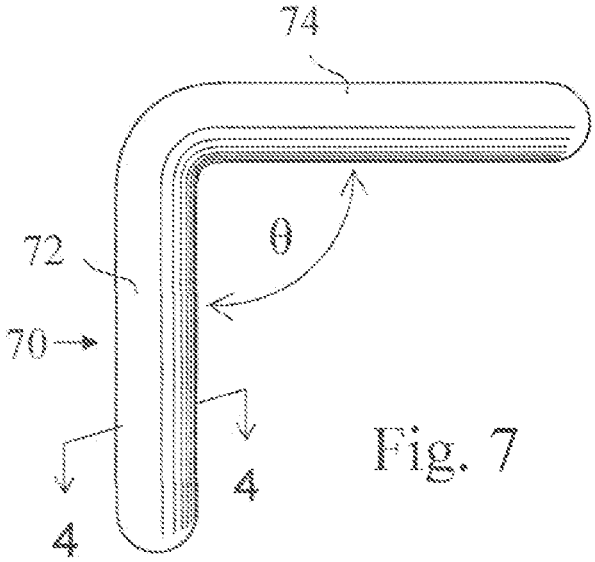
FIG. 7 is a plan view of a jaw exerciser having a first, second, and intermediate third portions, wherein all three portions have equivalent cross-sectional areas, and the first portion is disposed at an angle relative to the second portion.

First and second portions may also have substantially identical cross-sectional areas, such as cross-sectional areas 4-4 shown in FIGS. 6 and 7 depicting jaw exercisers 65 and 70, respectively. Jaw exerciser 65 includes three portions with substantially identical cross-sections that blend into a single, substantially uniform elongated portion 66, as shown in FIG. 6. Jaw exerciser 65 is configured to be partially inserted in the person's mouth, while the rest of the jaw exerciser remains outside the mouth. Exerciser 70, shown in FIG. 7, includes three portions with substantially identical cross-sections, wherein elongated portions 72 and 74 are disposed at an angle θ, and blend into a substantially uniform structure.

Figure 8:
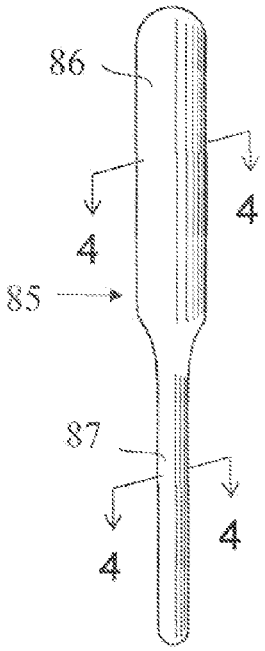
FIG. 8 is a plan view of an elongated jaw exerciser having a first, second, and intermediate third portions, wherein the first portion has a larger cross-sectional area than a cross-sectional area of each of the second and intermediate third portions.
Figure 9:
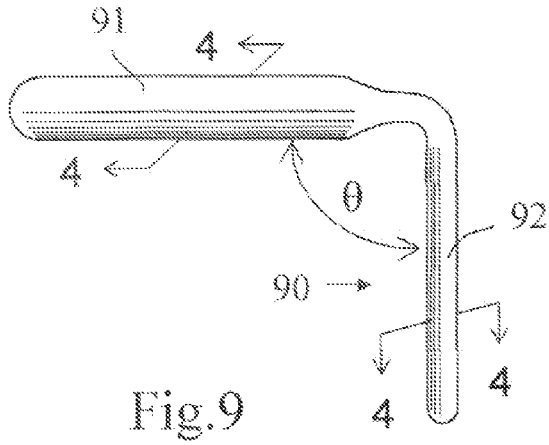
FIG. 9 is a plan view of a jaw exerciser having. a first, second, and intermediate third portions, wherein the first portion has a larger cross-sectional area than a cross-sectional area of each of the second and intermediate third portions, and the first portion is disposed at an angle relative to the second portion.

FIG. 8 depicts a jaw exerciser 85 having a first portion 86 and a second portion 87. Jaw exerciser 85 includes cross-sectional areas 4-4 of portion 86 and 4-4 of portion 87 that have a dissimilar magnitude. FIG. 9 depicts a jaw exerciser 90 having a first portion 91 and a second portion 92. Portions 91 and 92 are identical to portions 86 and 87, respectively, shown in FIG. 8, except that portion 92 is disposed at angle θ. Although angle θ is shown as being equal to approximately 90 degrees, the angle may also have a different magnitude.

Figure 10:
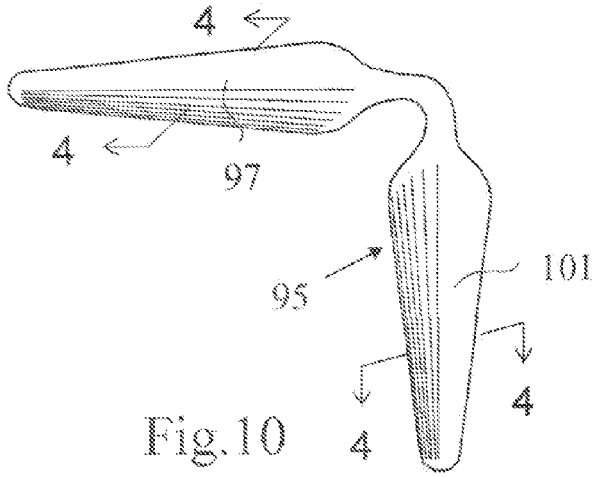
FIG. 10 is a plan view of a jaw exerciser having a first, second, and intermediate third portions, wherein the first and second portions have a tapered shape, and the first portion is disposed at an angle relative to the second portion.

The shape and profile of elongated portions may also vary. FIG. 10 depicts a jaw exerciser 95 having a first portion 97 and a second portion 101. Portions 97 and 101 of exerciser 95 have a substantially identical tapered shape. Variation of the cross-sectional area 4-4 of each portion 97 and 101 along the tapered profile allows for conformance of jaw exerciser 95 to individual bites.

Figure 11:
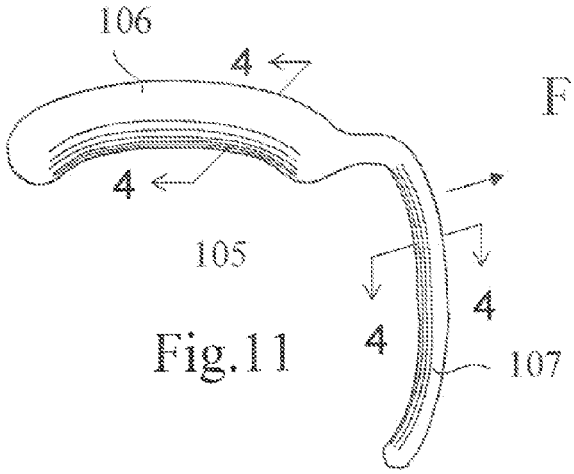
FIG. 11 is a plan view of a jaw exerciser having a first, second, and intermediate third portions, wherein the first and second portions are curved, and the first portion is disposed at an angle relative to the second portion.

FIG. 11 depicts a jaw exerciser 105 having a first portion 106 and a second portion 107. Portions 106 and 107 of jaw exerciser 105 are curved, and are thereby adapted to be conveniently positioned either on the left or the right side of a person's jaw.

Figure 12:
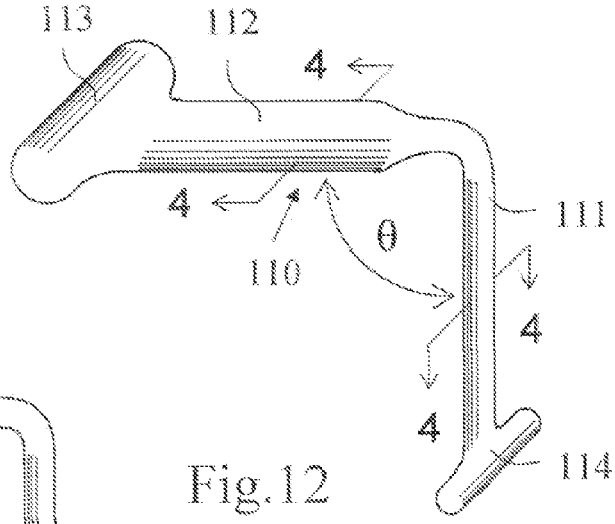
FIG. 12 is a perspective view of a jaw exerciser having a first, second, and intermediate third portions, wherein the first and second portions include perpendicular sections at their distal ends, and the first portion is disposed at an angle relative to the second portion.
Figure 13:
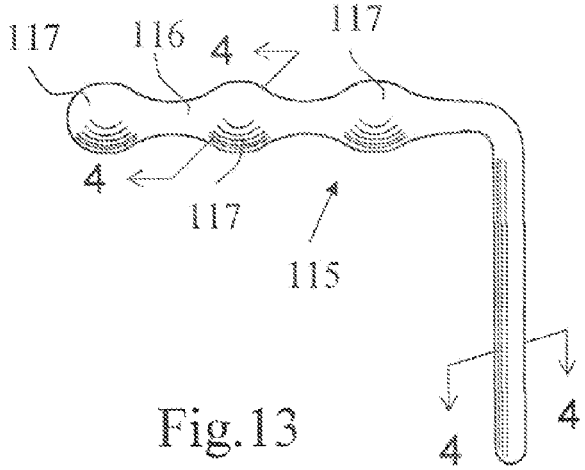
FIG. 13 is a plan view of a jaw exerciser having a first, second, and intermediate third portions, wherein with first portion has a shape of linked spheres, and the first portion is disposed at an angle relative to the second portion.

FIG. 12 depicts a jaw exerciser 110 having a first portion 112 and a second portion 111. Portions 111 and 112 include perpendicular sections 113 and 114 at their respective distal ends. Such configuration permits additional regulation of pressure applied to a person's teeth by jaw exerciser 110 during exercise. Additionally, the first portion 112 is disposed at angle θ relative to the second portion 111. Exerciser 115, shown in FIG. 13, includes a first portion 116 having a shape of connected spheres 117. Such a shape of first portion 116 provides variable resistance to different teeth, and allows for selective training of a person's individual teeth.

Figure 14:
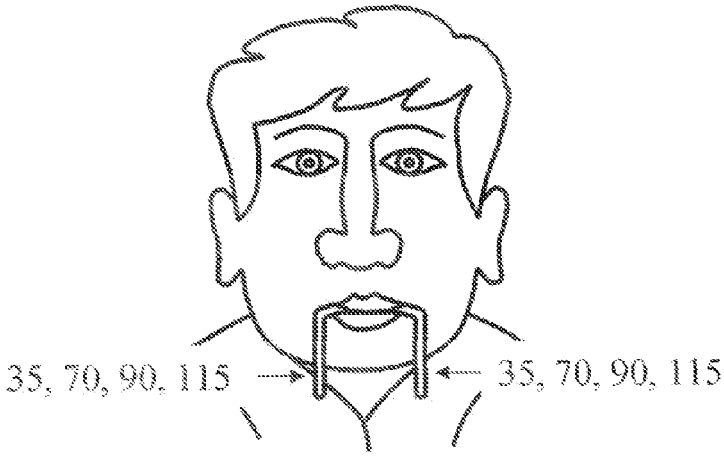
FIG. 14 illustrates a simultaneous application of two jaw exercisers, such as the jaw exercisers shown in FIGS. 2, 7, 9 and 13.

FIG. 14 shows a pair of jaw exercisers that may consist of any of the jaw exercisers 35, 70, 90, 115, described above, disposed within the mouth of a person at the same time, thereby providing simultaneous exercise for both left and right sides of a person's jaw.

Figure 15:
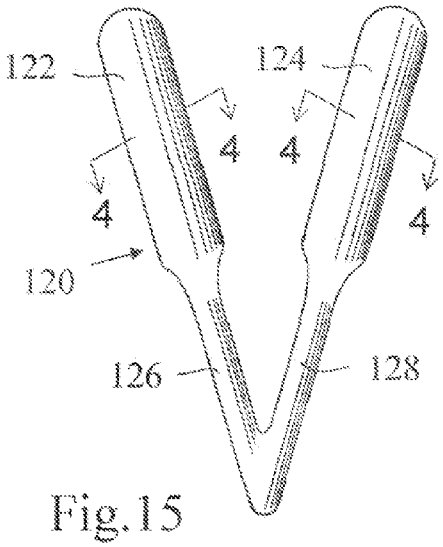
FIG. 15 illustrates a jaw exerciser that has an appearance of two jaw exercisers of the type shown in FIG. 8 having their second portions linked together.

FIG. 15 shows a jaw exerciser 120, which has an appearance of two jaw exercisers (each substantially like jaw exerciser 85 shown in FIG. 8) linked together. The jaw exerciser 120 includes two first portions. 122 and 124, and two second portions, 126 and 128. First portion 122 is spaced-apart from first portion 124. Second portions 126 and 128 are linked together at their distal ends.

Figure 16:
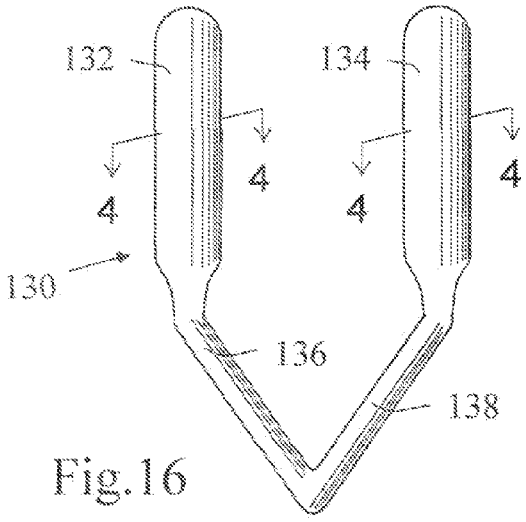
FIG. 16 illustrates a jaw exerciser that has an appearance of two jaw exercisers of the type shown in FIG. 9 having their second portions linked together.

FIG. 16 shows a jaw exerciser 130, which has an appearance of two jaw exercisers (each substantially like jaw exerciser 90 shown in FIG. 9) linked together. The jaw exerciser 130 includes two first portions, 132 and 134, and two second portions, 136 and 138. First portion 132 is spaced-apart from first portion 134. Second portions 136 and 138 are linked together at their distal ends.

Figure 17:
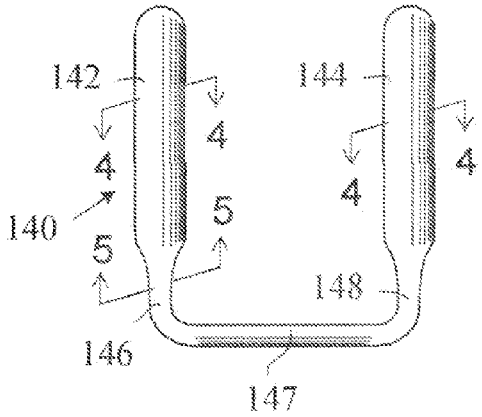
FIG. 17 illustrates a jaw exerciser that appears substantially like two jaw exercisers of the type shown in FIG. 9 having their second portions linked together via a connecting portion, wherein the connecting portion is a simple extension of second portions, linked together between first portions.

FIG. 17 shows a jaw exerciser 140, which appears to include two jaw exercisers (each substantially like jaw exerciser 90 shown in FIG. 9) linked together via a connecting portion 147. The jaw exerciser 140 includes two first portions 142 and 144, two second portions 146 and 148, and one connecting portion 147. First portion 142 is spaced-apart from first portion 144, and two second portions 146 and 148 are joined via the connecting portion 147. In FIG. 17 first portions 142 and 144 are shown disposed parallel to each other, however, the respective first portions may also be disposed relative to each other at an angle. Connecting portion 147 is attached to respective ends of second portions 146 and 148. Connecting portion 147 may be a simple extension of second portions 146 and 148, linked together between first portions 142 and 144.

Figure 18:
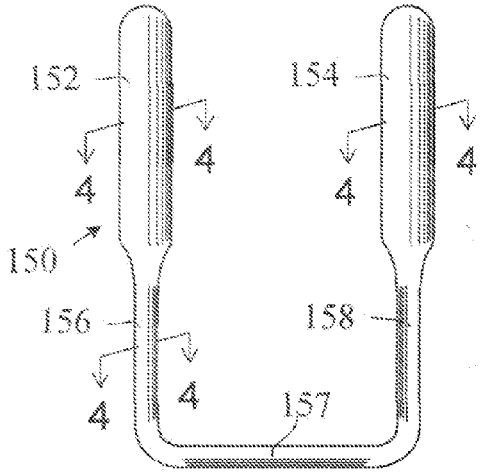
FIG. 18 illustrates a jaw exerciser that appears substantially like two jaw exercisers of the type shown in FIG. 8 having their second portions linked together via a connecting portion.

FIG. 18 shows a jaw exerciser 150, which has an appearance of two jaw exercisers (each substantially like jaw exerciser 85 shown in FIG. 8) linked together via a connecting portion 157. The jaw exerciser 150 includes two first portions, 152 and 154, and two second portions, 156 and 158. First portion 152 is spaced-apart from first portion 154, and second portion 156 is spaced-apart from second portion 158. In FIG. 17 first portions 152 and 154 are shown disposed parallel to each other, and second portions 156 and 158 are shown disposed parallel to each other as well, however, the respective first and second portions may also be disposed at an angle. Connecting portion 157 is attached to respective ends of second portions 156 and 158.

Figure 19:
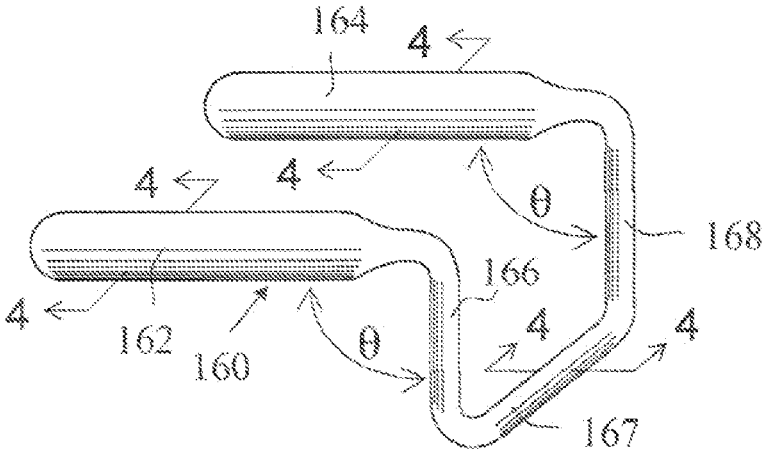
FIG. 19 is a perspective view of two jaw exercisers shown in FIG. 9, wherein the two jaw exercisers have their second portions linked together via a connecting portion.

FIG. 19 shows a jaw exerciser 160 having two first portions, 162 and 164, and two second portions, 166 and 168. Second portions 166 and 168 are substantially identical to portions 156 and 158 (shown in FIG. 18), respectively, except that portions 166 and 168 are disposed at angle θ. Angle θ may have a magnitude of approximately 90 degrees, or any other magnitude as desired.

Figure 20:
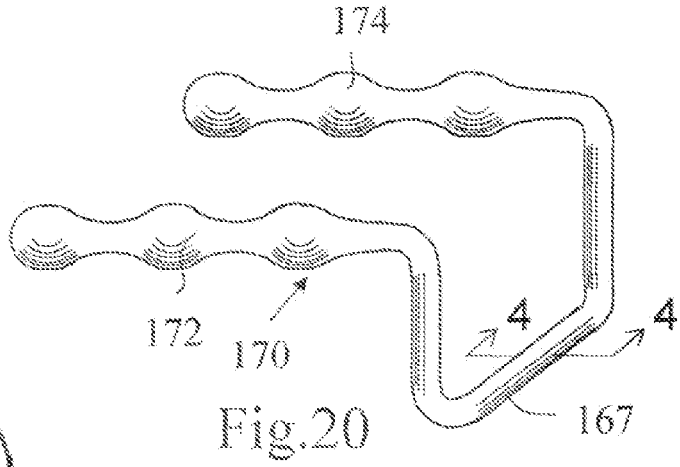
FIG. 20 is a perspective view of two jaw exercisers shown in FIG. 13, wherein the two jaw exercisers have their second portions linked together via a connecting, portion.
Figure 21:
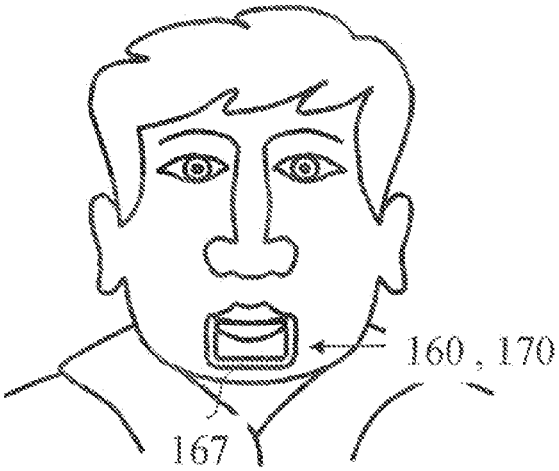
FIG. 21 illustrates application of a jaw exerciser such as shown in FIGS. 19 and 20.

FIG. 20 shows jaw exerciser 170 similar to jaw exerciser 160, shown in FIG. 19, except that first portions 172 and 174 have a shape of connected spheres. FIG. 21 shows a jaw exerciser, such as 160 or 170, disposed within a mouth of a person, with connecting portion 167 positioned outside the person's mouth.

Figure 22A:
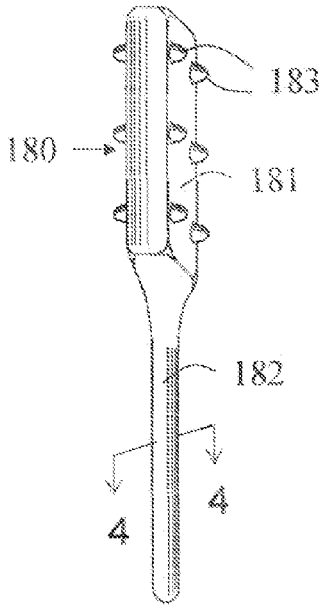
FIGS. 22 (*a*-*c*) illustrate a perspective view of some of the possible projections disposed on an outer surface of a first portion of an elongated jaw exerciser.
Figure 22B:
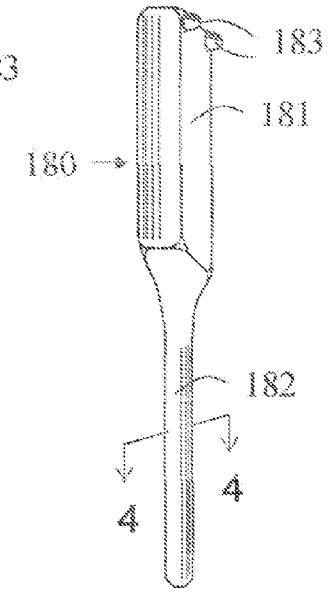
Figure 22C:
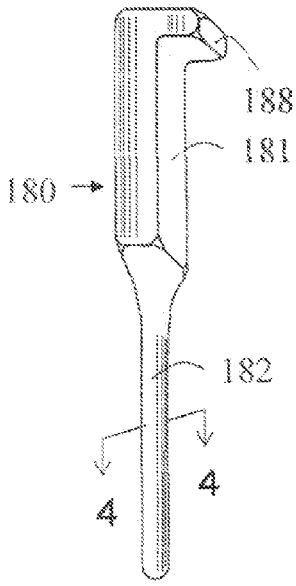

FIGS. 22 (*a*-*c*) show a first portion 181 of jaw exerciser 180. First portion 181 may have a variety of projections that help prevent the chewing teeth from slipping over the edge of the jaw exerciser in order to preclude injury. Projections may be configured as edge-guiding tips 183 disposed on each side of the first portion 181 (FIG. 22*a*), edge-guiding tips 183 disposed on the distal end of first portion 181 (FIG. 22*b*), or an edge-guiding rib 188 on the distal end of portion first 181 (FIG. 22*c*). Portions 192 and 194, shown in FIG. 23, are identical to portions 181 and 182, respectively, shown in FIG. 22, except that portion 192 is shown as disposed at angle θ of approximately 90 degrees.

Figure 23:
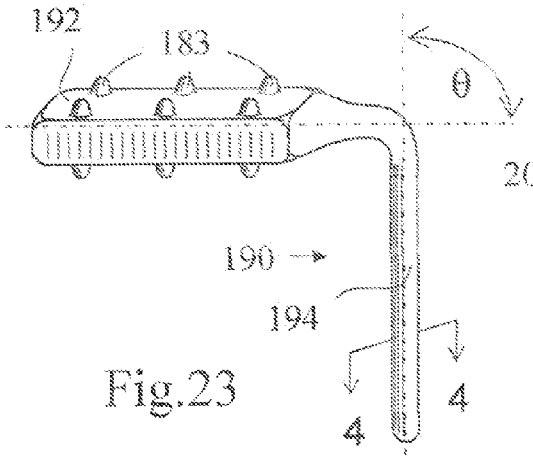
FIG. 23 is a perspective view of a jaw exerciser having projections shown in FIG. 22*a*, wherein the first portion is arranged at an angle relative to the second portion.
Figure 24:
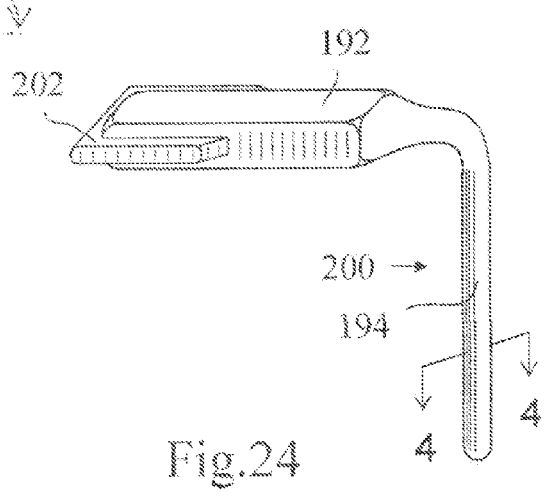
FIG. 24 is a perspective view of a jaw exerciser having a skirt disposed on the perimeter of the first portion, wherein the first portion is arranged at an angle relative to the second portion.

Jaw exerciser 200 shown in FIG. 24 is identical to jaw exerciser 190, shown in FIG. 23, except that jaw exerciser 200 includes a projection 202 configured as a skirt around the perimeter of the distal end of first portion 192. Skirt 202 may extend either completely or partially around the perimeter of the first portion 192.

Rigidity of the jaw exerciser is determined by the material selected for its construction, as well as by the size and the configuration of its portions. Rigidity of the jaw exerciser may be controlled via a material selected for fillers 42 and 44, shown in respective FIGS. 4*g* and 4*h*. Fillers 42 or 44 can be configured from any suitable resilient material, such as plastic, silicone or rubber, while the inner cavity may also be filled with a fluid.

Various medicinal herbs and other medications may also be used as fillers and coatings, thereby providing additional health benefits to a person during the exercise. The jaw exerciser may also be filled with any, preferably natural substances in order to create a desired flavor and/or aroma. The jaw exerciser may be saturated, filled or covered by substances with a fragrant, aromatic, soothing and/or healing scent, such as provided by essential oils, tinctures and spices.

While the best modes for carrying out the intention have been described in detail, those familiar with the art to which this invention relates will recognize various alternative designs and embodiments for practicing the invention within the scope of the appended claims.

The invention claimed is:

1. A jaw exerciser comprising:

an elongated first portion disposed along a first axis, characterized by two opposing ends and a first cross-section having a first area and a first shape, wherein the first portion is configured to be inserted into the mouth, and includes an outer surface configured to be at least one of engaged, clenched, and masticated by the teeth;

an elongated second portion disposed along a second axis arranged at an angle that is in the range of approximately 90 to 180 degrees relative to the first axis, characterized by two opposing ends, an outer surface, and a second cross-section having a second area and a second shape, wherein the second portion is configured to one of remain outside the mouth when the first portion is inserted into the mouth and be inserted into the mouth to be at least one of engaged, clenched, and masticated by the teeth when the first portion remains outside the mouth; and an intermediate portion characterized by a third cross-section having a third area and a third shape, wherein the intermediate portion joins the first and second portions, and configured to pass through and be grasped and encircled by the lips to thereby retain saliva inside the mouth when one of the first and the second portions is being at least one of engaged, clenched, and masticated by the teeth; and at least one of the first and second shapes is substantially oval or polyangular.

2. The jaw exerciser of claim 1, wherein the third area is smaller than at least one of the first and second areas, and wherein the third shape is one of substantially round and substantially elliptical.

3. The jaw exerciser of claim 1, wherein the angle is substantially equal to 90 degrees.

4. The jaw exerciser of claim 1, wherein at least one of the outer surface of the first portion and the outer surface of the second portion is resilient.

5. The jaw exerciser of claim 1, wherein at least one of the outer surface of the first portion and the outer surface of the second portion includes at least one projection.

6. The jaw exerciser of claim 1, wherein the outer surfaces of the first and second potions portions are configured from a first material and at least one of the first and second portions defines an enclosed cavity filled with a second material.

7. The jaw exerciser of claim 1, wherein at least one of the first and second portions is saturated by at least one of a medicinal and a fragrant substance.

8. The jaw exerciser of claim 1, wherein the third area is smaller than at least one of the first and second areas, and each of the first and second portions is substantially straight.

9. The jaw exerciser of claim 1, wherein at least one of the outer surface of the first portion and the outer surface of the second portion is resilient, and wherein the jaw exerciser is characterized by monolithic construction.

* * * * *